US011649655B2

(12) United States Patent
Baum et al.

(10) Patent No.: US 11,649,655 B2
(45) Date of Patent: May 16, 2023

(54) LOCK FORMED BY A STRAND, FOR SECURING OBJECTS

(71) Applicant: Alexandra Baum, Leipzig (DE)

(72) Inventors: Alexandra Baum, Leipzig (DE); Roxana Miksch, Altenstadt (DE)

(73) Assignee: Alexandra Baum, Leipzig (DE)

( * ) Notice: Subject to any disclaimer, the term of this patent is extended or adjusted under 35 U.S.C. 154(b) by 383 days.

(21) Appl. No.: 16/595,676

(22) Filed: Oct. 8, 2019

(65) Prior Publication Data

US 2020/0040603 A1 Feb. 6, 2020

Related U.S. Application Data

(62) Division of application No. 15/570,037, filed as application No. PCT/EP2016/000694 on Apr. 29, 2016, now Pat. No. 10,465,418.

(30) Foreign Application Priority Data

Apr. 29, 2015 (DE) ..... 10 2015 005 411.2
Apr. 29, 2015 (DE) ..... 10 2015 005 412.0

(51) Int. Cl.

| | |
|---|---|
| ***E05B 15/16*** | (2006.01) |
| ***E05B 45/00*** | (2006.01) |
| ***E05B 67/00*** | (2006.01) |
| *E05B 47/00* | (2006.01) |

(52) U.S. Cl.

CPC ..... *E05B 15/16* (2013.01); *E05B 45/005* (2013.01); *E05B 67/00* (2013.01); *E05B 67/003* (2013.01); *E05B 2047/0094* (2013.01)

(58) Field of Classification Search

CPC ..... E05B 45/005; E05B 15/16; E05B 67/00; E05B 67/003; E05B 2047/0094; Y10T 70/40; Y10T 70/409; Y10T 70/435; Y10T 70/483; Y10T 70/491; Y10T 70/5009; Y10T 70/5872; Y10S 70/49

USPC ..... 70/14, 18, 30, 49, 53, 58, 233, DIG. 49; 340/542

See application file for complete search history.

(56) References Cited

U.S. PATENT DOCUMENTS

| | | | | |
|---|---|---|---|---|
| 4,412,474 A | | 11/1983 | Hara | |
| 4,546,345 A | * | 10/1985 | Naito | E05B 45/005 340/427 |
| 4,595,793 A | * | 6/1986 | Arroyo | H01B 7/295 156/53 |
| 5,408,212 A | * | 4/1995 | Meyers | E05B 73/0011 340/427 |
| 5,706,679 A | * | 1/1998 | Zane | E05B 67/003 70/18 |

(Continued)

FOREIGN PATENT DOCUMENTS

| | | |
|---|---|---|
| CN | 203113965 U | 8/2013 |
| CN | 203513966 U | 4/2014 |

(Continued)

*Primary Examiner* — Suzanne L Barrett
*Assistant Examiner* — Suzanne D Barrett
(74) *Attorney, Agent, or Firm* — Olson & Cepuritis, Ltd.

(57) ABSTRACT

A closure for a strand lock having a securing strand, a locking pin with a latch, and a locking housing defining a receptacle for the locking pin is provided with a rotatable coupling element on the locking pin. Rotation of the coupling element secures the latch in the housing.

11 Claims, 8 Drawing Sheets

(56) References Cited

U.S. PATENT DOCUMENTS

| | | | | |
|---|---|---|---|---|
| 5,896,762 | A * | 4/1999 | Iidaka | E05B 73/0017 70/57.1 |
| 7,954,410 | B2 | 6/2011 | Prescott et al. | |
| 9,260,885 | B2 * | 2/2016 | Asquith | E05B 39/005 |
| 9,728,302 | B1 * | 8/2017 | McNutt | G02B 6/441 |
| 10,465,418 | B2 * | 11/2019 | Baum | E05B 67/00 |
| 2011/0219826 | A1 * | 9/2011 | Jeli | E05B 73/0005 70/15 |
| 2016/0024818 | A1 * | 1/2016 | Allen | E05B 71/00 70/30 |
| 2016/0319572 | A1 * | 11/2016 | Allen | E05B 37/0068 |
| 2020/0332564 | A1 * | 10/2020 | Baum | E05B 71/00 |

FOREIGN PATENT DOCUMENTS

| | | | |
|---|---|---|---|
| FR | 2762761 | A1 | 11/1998 |
| JP | 3163872 | U | 11/2010 |
| WO | 2004020732 | A2 | 3/2004 |
| WO | 2011091474 | A1 | 8/2011 |
| WO | WO2019/115430 | * | 6/2019 |

* cited by examiner

LOCK FORMED BY A STRAND, FOR SECURING OBJECTS

CROSS-REFERENCE TO RELATED APPLICATIONS

This application is a division of U.S. patent application Ser. No. 15/570,037, filed on Oct. 27, 2017, now U.S. Pat. No. 10,465,418, which is a 371 National Stage of International Application No. PCT/EP2016/000694, filed Apr. 29, 2016, which claims priority of German Patent Application No. 10 2015 005 411.2, filed on Apr. 29, 2015, and German Patent Application No. 10 2015 005 412.0, filed on Apr. 29, 2015, each of which is incorporated herein by reference.

FIELD OF INVENTION

The invention relates to a strand lock for securing objects, and to a securing strand, and to a closure of a strand lock.

BACKGROUND OF INVENTION

Locks for securing objects are known in a diversity of types. These include padlocks, U-locks, and cable locks, the latter also including spiral locks. In the field of bicycles and motorcycles, spoke locks, handlebar locks, bottom-bracket locks and the like are also known, these however being fixedly connected to the respective object. Apart from bicycles and motorcycles, other objects can also be secured against theft or unauthorized opening by way of such locks.

SUMMARY OF INVENTION

The present invention relates especially to strand locks which topically also comprise cable locks, since the latter have flexibility and thus can be adapted to the object to be secured. Cable locks usually have a securing cable from metal wires which are conjointly twisted to form a cable. In order not to be committed to metallic cable locks, the term "strand lock" was chosen since a "strand" can also be formed from other materials but can optionally also comprise metals.

It is the object of the present invention to improve such strand locks. The strand lock according to the invention is to have in particular an adequate resistance and at the same time a low weight combined with high flexibility. It is also desirable for the lock to be able to be operated in a very simple manner.

It has been recognized that this object can be achieved in that in instead of a usually used securing cable that is largely composed of metal wires a securing strand having textile fibers is henceforth used for the securing strand. On account thereof, the strand lock, while maintaining the same resistance, can be designed so as to be substantially lighter and more flexible such that said strand lock is more comfortable to be transported and operated by the user. It is preferable herein that the securing strand, apart from metallic coatings or foil-type or wire-type intermediate layers that are optionally present, and an external sheathing and binding agents or adhesives, respectively, for the fibers, is substantially composed of only the textile fibers.

The strand lock according to the invention for securing objects, in particular bicycles and motorcycles, thus comprises a securing strand, a locking housing that is disposed on one side of the securing strand, and a securing pin (locking pin) that is disposed on the other side of the securing strand and is receivable in a locking manner in the locking housing, said strand lock being characterized in that the securing strand has cut-resistant textile fibers.

"Securing pin" or "locking pin", respectively, in the context of the present invention does not only mean locking elements that are configured in the manner of a pin, but any locking means which can be at least in part received in another locking means, which is why these other locking means in the context of the present invention are referred to as a "locking housing".

Additionally, the textile fibers are preferably highly capable of being stressed for elongation. Objects (for example loudspeaker boxes) could thus also be secured when suspended, wherein the strand lock at the same time also supports the load of the object. It is provided in one advantageous refinement that the textile fibers comprise aramid and/or ultra-high molecular weight polyethylene (UHMW-PE). Such textile fibers are particular cut-resistant and tear-resistant.

The resistance can yet be significantly increased in that the textile fibers are present as a braided fabric, wherein preferably at least one first braided fabric which forms the core of a second braided fabric is present. Such braided fabrics can be made in a seamless manner as a tubular fabric. Alternatively, woven fabrics can also be used. Not only two but also three, four, or more braided fabrics or woven fabrics can be present herein. However, an interlacing is in each case present such that the inner braided fabric or woven fabric forms the core of a subsequently disposed braided fabric or woven fabric.

The material properties of the textile fibers that are disposed dissimilarly in relation to the cross section of the securing strand, or of the different braided fabrics or woven fabrics, respectively, herein can be chosen so as to be identical. However, said material properties are preferably dissimilar in order for optimal overall properties of the securing strand to be generated. For example, more inboard textile fibers can have a high tensile strength, and more outboard textile fibers can have a high resistance to cutting.

Flame resistance is very high when a metallic layer is disposed below and/or above the textile fibers, wherein the metallic layer preferably comprises metal wires, a metallic foil, or a metallic coating of the textile fibers, wherein the metallic layer is in particular configured so as to be compact. However, layers which are not compact and which in particular have a single wire which is advantageously placed in a helical manner can also be present.

It is particularly expedient in this context when at least the external tiers of the textile fibers are activated for coating. This can be performed by a plasma treatment, for example, on account of which the outermost fiber layer is fissured. A metallic coating which is applied by means of PVD (physical vapor deposition), electron-beam evaporation, galvanic methods, or dipping, for example, adheres in a significantly improved manner in this instance.

Such an activation is however also advantageous for other coatings, for example from plastics, because a more inherent connection between the fibers and the coating can be established in this instance.

It is provided in one advantageous design embodiment that the securing strand and/or the textile fibers has/have a sheathing which is preferably configured so as to be UV-impermeable. The textile fibers on account thereof are effectively protected from weather influences. Moreover, this sheathing also holds together textile fibers that protrude from the fiber composite. Further textile fibers which do not necessarily have to fulfil securing aspects but instead can be printed in order for the strand lock to be graphically designed in a particular manner can be disposed above the sheathing. Alternatively, the sheathings can also be printed or be adapted in terms of color in order for a desired design to be achieved.

This sheathing can also be configured as a coating, wherein the activation mentioned above can also be performed.

If the sheathing comprises abrasive materials, tools that engage thereon can be blunted. Such abrasive materials can be sand, shavings, or powder, for example granite or corundum.

The sheathing can moreover comprise a plastics material, in particular polytetrafluoroethylene (Teflon®), acrylic, and/or silicone, which provide a particularly effective protection of the securing strand.

Intelligent securing of the strand lock is possible when at least one electrical conductor is disposed in the securing strand, and alarm means which trigger an alarm when the electrical conductor is severed are provided. This alarm by way of suitable transmitting means could then be transmitted directly to an application of a mobile computer device of the owner of the strand lock.

This at least one electrical conductor can be present in various ways which can also be combined with one another. Said electrical conductor can thus be integrated in an internal core; said electrical conductor can be present in the context of a metallic layer; or said electrical conductor can be integrated in the textile fibers, for example be incorporated in at least one textile braided fabric or woven fabric, respectively.

It is provided in one particularly advantageous design embodiment that the locking pin in relation to the securing strand in a first operating state is configured so as to have a freewheel feature, and the locking pin in relation to the locking housing in a second operating state is configured so as to be lockable and unlockable, wherein the operating states are preferably remote-controllable, in particular by means of a transponder. The strand lock can then be operated in a particularly easy and rapid manner. There is thus either the freewheel feature, or the locking pin in relation to the locking housing is configured so as to be lockable and unlockable.

Independent protection is claimed for this design embodiment having a freewheel feature, that is to say that the configuration of the securing strand having cut-resistant textile fibers does not have to be provided for this design embodiment, but arbitrary securing strands can be used therefor.

In one advantageous refinement a coupling element is provided between the locking pin and the securing strand, wherein the securing strand is fixedly connected to the coupling element. The freewheel feature in the first operating state then is present between the locking pin and the coupling element.

It is provided in one advantageous refinement that the closure has mutually engaging closure means which in each case have end faces which in the locked state of the closure bear on one another. It is provided herein that the securing strand is fastened to at least one closure means such that this fastening is accessible only by way of the end face of the closure means. There is then a high level of security in terms of manipulation in the case of unauthorized access.

This type of fastening is particularly preferably present in the case of both closure means. For example, the securing strand is thus fastened to the locking housing and to the locking pin or the coupling element, respectively.

A high level of security in terms of manipulation is also present when access to the interior of the locking housing and/or to the locking pin or the coupling element, respectively, takes place by way of the respective end face.

It is preferred not only in this context that the receptacle of the locking pin in the locking housing is configured so as not to be rotatable, wherein the locking pin in relation to the locking housing is preferably configured so as not to be rotationally symmetrical. The locking mechanism can then be provided in a very simple manner.

The locking mechanism in terms of construction can be provided in a very simple manner even when the locking pin has a pivotable latch which engages in a corresponding groove in the locking housing.

Independent protection is claimed for the securing strand according to the invention, which in conjunction with a lock can be used as an extended securing means, for example. In this case, the securing strand would have at least two ends which are provided with eyelets for fastening to a lock.

The lock can be the strand lock according to the invention, for example, or a padlock or a like lock.

As an alternative to eyelets, loops can also be present. Such loops or eyelets can be generated by clamping a bent end of the securing strand to the securing strand by means of a clamp of metal or plastics, for example, wherein it is preferably provided that the connection point is cladded, in particular insert-cast. A plastics material is particularly suitable therefor. The loop can also be formed by stitching and thereafter be cast in plastics.

As an alternative to two eyelets or to loops, only one eyelet or loop can also be present, while the other end of the securing strand does not have such an eyelet or loop but a suitable securing element which can be blocked in a dedicated locking or securing device, respectively. Securing of objects could thus be performed in that the securing strand is routed around the object, the free end herein being pulled through the eyelet or the loop, and blocking of the free end then being performed. The blocking mechanism can be configured in a manner similar to a Kensington® lock of the Kensington Computer Products Group, for example.

Independent protection is furthermore claimed for the closure of a strand lock according to the invention, which can be used by the way of example in conjunction with the securing strand according to the invention, or else with any other securing strand, and on account of which significant advantages in terms of handling in comparison to normal strand locks result. This closure has the particular properties according to the invention in terms of the two operating states.

The characteristics and further advantages of the invention will become evident in the context of the following description of a preferred exemplary embodiment in conjunction with the figures. Herein, in a purely schematic manner:

DESCRIPTION OF PREFERRED EMBODIMENTS

Figure 1:
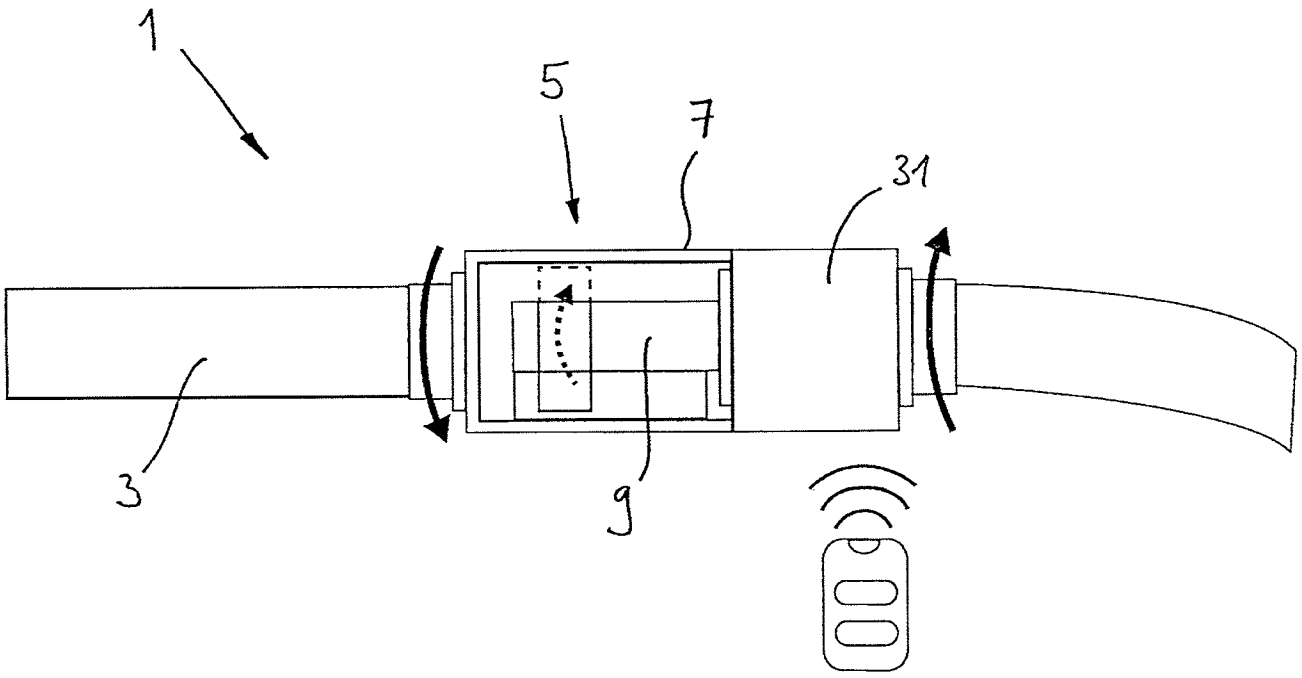
FIG. 1 shows the strand lock according to the invention as per a first preferred design embodiment in a first view.

The strand lock 1 according to the invention as per a first preferred design embodiment is illustrated in a purely schematic manner in various views in FIGS. 1 to 4, wherein individual inboard elements for a better understanding are depicted in a partially transparent manner.

It can be seen that the strand lock 1 has a securing strand 3 (which is encircling but for reasons of clarity is only partially shown) according to the invention, and a closure 5 according to the invention, which is fastened to the former, wherein the closure 5 has a locking housing 7 and a locking pin 9.

Figure 2:
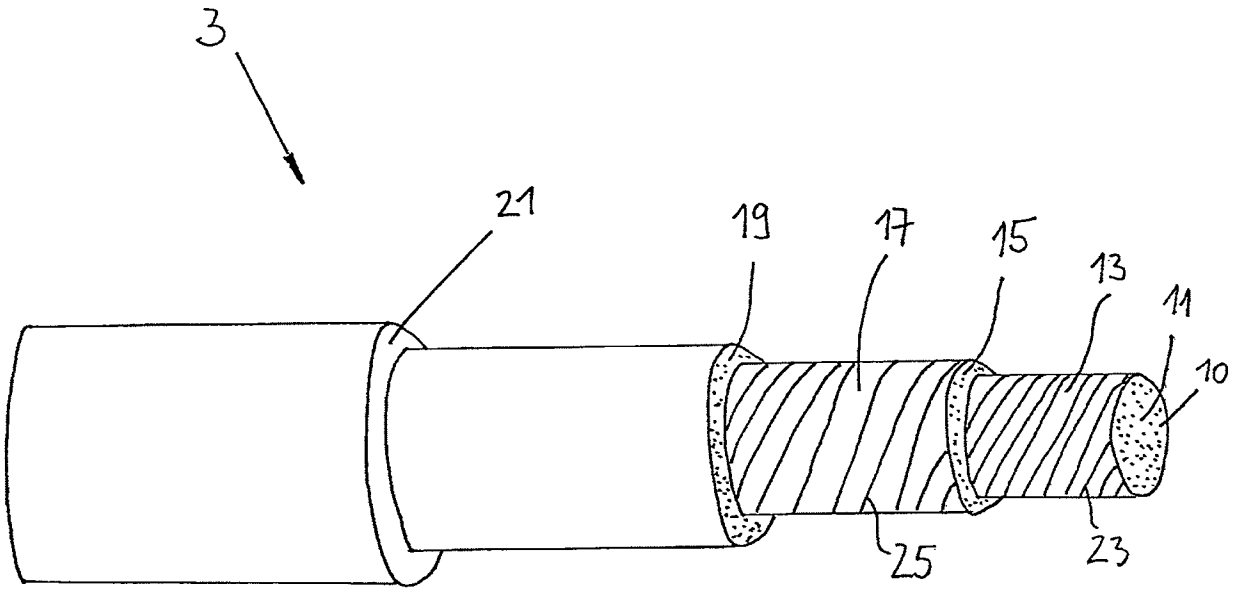
FIG. 2 shows the construction of the securing strand according to the invention, as per FIG. 1.

It can be seen in FIG. 2 that the securing strand 3 according to the invention has substantially only textile fibers 10, specifically the fiber Dyneema® (an UHMW-PE, for example SK38 or SK78) by the DSM N.V. company, said fibers in each case being woven to form braided fabrics. A braiding core 11 herein is composed of braided Dyneema® fibers that is surrounded by an aluminum foil 13. Both form the core of the braided fabric 15 which is likewise braided from Dyneema® fibers. The braided fabric 15 in turn is surrounded by an aluminum foil 17, all this forming the core of the braided fabric 19 which is likewise braided from Dyneema® fibers. This braided fabric 19 is surrounded by a sheathing 21 from silicone or other plastics mixed with granite powder or other abrasive materials.

As is illustrated in FIG. 2, wire wrappings 23, 25 can be provided alternatively or additionally to the aluminum foils 13, 17. Depending on the desired resistance, only one or two of the three braided fabrics 11, 15, 19 shown can also be used. More than three braided fabrics can also be used.

The overall properties of the securing strand 3 can be positively influenced when the braided fabrics have dissimilar properties. For example, the braided fabrics 11, 15 should have a high tensile resistance and the braided fabric 19 should have a high cutting strength such that the securing strand 3 as an entity cannot be destroyed from the outside by cutting and the like, and also not by elongating.

Figure 3A:
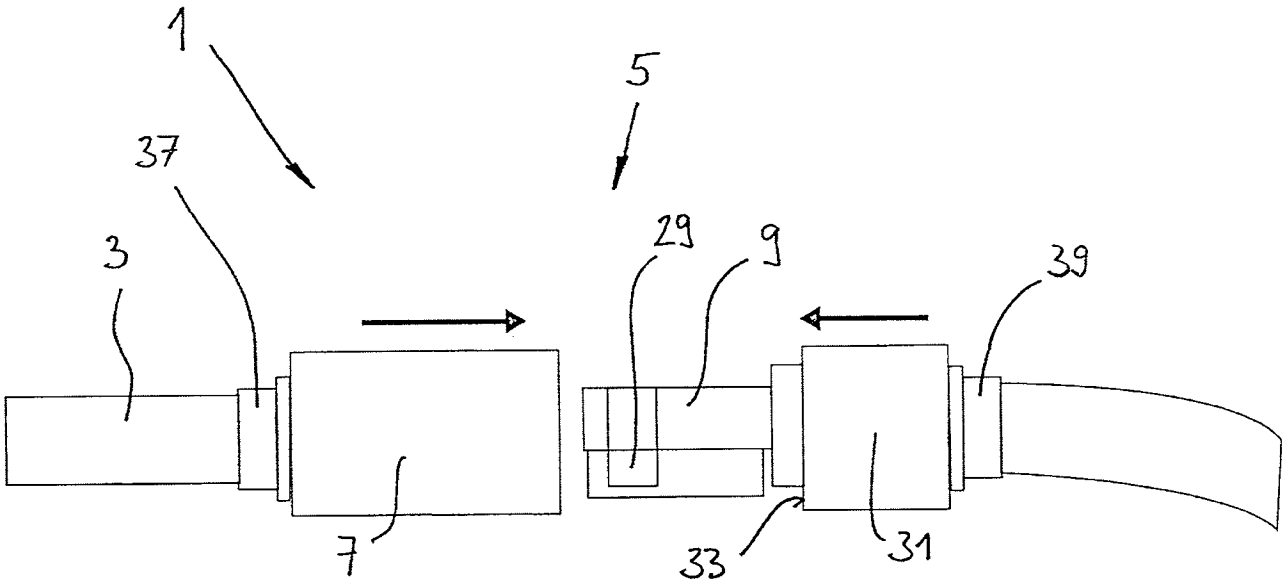
FIGS. 3*a*, 3*b* show the closure of the strand lock according to the invention as per FIG. 1, in an opened state.
Figure 3B:
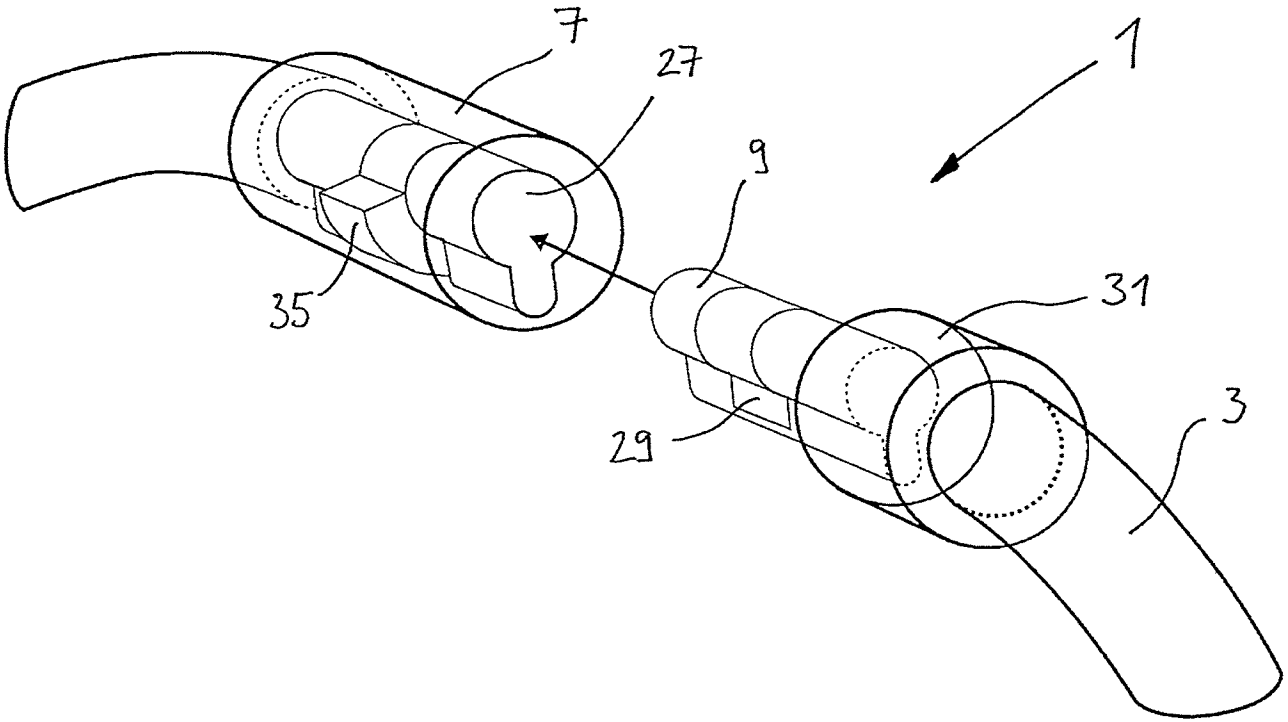
Figure 4:
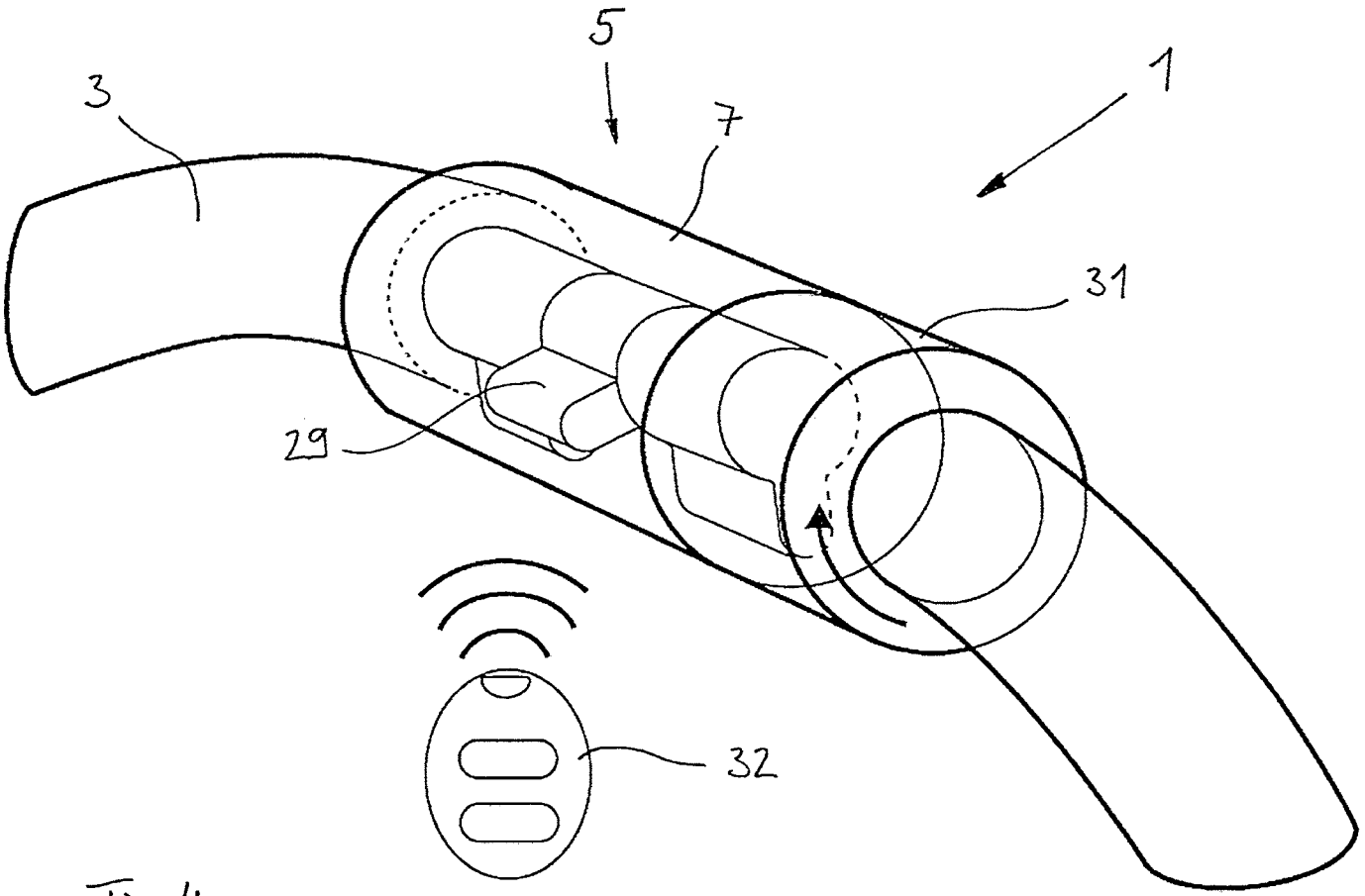
FIG. 4 shows the closure of the strand lock according to the information as per FIG. 1, in the locked state.

The closure 5 according to the invention is illustrated in more detail in FIGS. 3 to 4. It can be seen that the locking housing 7 has a receptacle 27, which is not rotationally symmetrical, for the locking pin 9 which is configured in a corresponding manner and is thus introducible into the receptacle 27 in a rotationally secured manner. The shape in the exemplary embodiment proposed is that of a locking cylinder, the cross section of the locking pin 9 thus being that of a keyhole.

The locking pin 9 has a pivotable latch 29 which can be pivoted in a manner perpendicular to the longitudinal extent of the locking pin 9. Moreover, a coupling element 31 which in turn is connected to the securing strand 3 is disposed on the locking pin 9.

The coupling element 31 in relation to the locking pin 9 has a conditional freewheel feature of such a type that an arbitrary rotation of the coupling element 31 about a locking pin 9 is possible in both directions in a first operating state. The coupling element 31 in a second operating state is fixedly coupled to the locking pin 9 such that a rotation of the coupling element 31 acts directly on the latch 29 which on account thereof can be activated.

Switching of the two operating states can be performed by arbitrary keys, wherein in the exemplary embodiment illustrated a digital key which is transmitted by a transponder 32 to a corresponding receiving, evaluating and activating unit (not shown) in the interior of the coupling element 31 is preferably used. The description of the precise mechanical implementation of the conditional freewheel feature is dispensed with since the latter is known from transponder-activated locking systems in the sector of door security, for example by the SimonsVoss Technologies GmbH company. The particular design by way of which such a system becomes employable in the cable-lock sector in the first place is novel herein.

The power supply to the receiving, evaluating and activating unit is performed by way of at least one DC current source (not shown) which is disposed in the interior of the coupling element 31. Access to this DC current source is by way of the end face 33 of the coupling element 31 which in the locked state (cf. FIG. 4) is covered by the locking housing 7 such that the access is protected from manipulation.

It can be seen in FIG. 3*b* that the receptacle 27 in the locking housing 7 has a groove 35 which in terms of the location and dimensions thereof is configured such that the latch 29 of the locking pin 9 in the case of the strand lock 1 being locked in the state shown in FIG. 4 can be pivoted into the groove 35.

The fastening of the securing strand 3 to the locking housing 7 and to the locking pin 9 is performed in that the locking housing 7 and the locking pin 9 each have eyelets (not shown) which are surrounded in terms of braiding by and adhesively bonded to the securing strand 3. Sleeves 37, 39 which are adhesively bonded to the securing strand 3 and to the locking housing 7 or to the locking pin 9, respectively, are disposed above these eyelets. Epoxy resins are suitable for adhesive bonding, and so-called prepregs in the form of aramid or carbon fibers, or hybrid fibers, respectively, are preferably used for the production of the sleeves. Since the locking housing 7 and the locking pin 9 per se are composed of a high-tensile and resilient steel or the like, a strand lock 1 as a whole is obtained which corresponds to all security requirements which for bicycles, for example, are established in the technical guidelines TR 3422 "Empfehlenswerte bewegliche Fahrrad-Schlösser, Anforderungen an Sicherheit and Gebrauchstauglichkeit; Prüfverfahren" ("Recommended portable bicycle locks, requirements in terms of security and usability; test method") of the ADFC (Allgemeiner Deutscher Fahrrad-Club e.V.—General Bicycle Club of Germany).

The strand lock 1 according to the invention is now operated as follows. The strand lock 1 in the state illustrated in FIG. 4 is locked and cannot be opened. The locking pin 9 in relation to the locking housing 7 is secured against rotation, and the closure 5 by way of the engagement of the latch 29 in the groove 35 is locked. A rotation of the coupling element 31 in relation to the locking housing 7 is possible by virtue of the conditional freewheel feature (cf. also FIG. 1).

In the authentification of the owner (not shown) of the strand lock 1, said owner in a first step with the aid of the transponder 32, for example in a wireless manner or a similar remote transmission, transmits an authentification signal which is read and identified as being correct by the receiving, evaluating and activating unit (not shown) in the interior of the coupling element 31, on account of which said receiving, evaluating and activating unit switches off the freewheel feature and instead fixedly couples the latch 29 to the coupling element 31.

On account thereof, in a second step, the latch 29 can be removed from the groove 35 by the user by rotating the coupling element 31 in relation to the locking housing 7, on account of which the locking pin 9 can be retrieved from the locking housing 7 and the closure 5 can be opened. Subsequently, the object (not shown) that was originally secured by the strand lock 1 can be freely availed of again.

In order for the object to be secured again, the locking pin 9 in a third step is reintroduced into the locking housing 7, and the closure 5 is thus closed (cf. FIGS. 3*a*, 3*b*), and the latch 29 by rotating the coupling element 31 in relation to the locking housing 7 is moved into the groove 35 (cf. also FIGS. 1 and 4). In a fourth step, the conditional freewheel feature with the aid of the receiving, evaluating and activating unit is switched on again by activating the transponder 32 again, on account of which the strand lock 1 is securely locked until the latter is unlocked again with the aid of the transponder 32.

The freewheel feature in this example is switched in each case by means of the transponder 32, such that after the strand lock 1 following unlocking and opening as described above can be directly locked again without activating the transponder 32 once more, since the freewheel feature is still switched off.

By contrast however, when unauthorized unlocking and non-locking due to the fourth step being neglected is to be prevented, it can alternatively be provided that the conditional freewheel feature is automatically switched on after a specific time period, for example after 3 to 5 seconds, upon activation of the transponder 32.

It can optionally also be provided that the user can switch between these two variants, for example by way of a switch on the transponder 32, or by way of a specific combination of activations of the transponder 32.

In order for the locking and unlocking procedure to be facilitated, it is provided that the groove 35 extends in only one direction and also only at a specific angle, for example 90° (cf. FIG. 3*b*), such that the latch 29 can be pivoted in only one direction, and has a detent such that any unintentional unlocking of the closure 5 is prevented.

In the exemplary embodiment proposed, the locking pin 9 has a cross section similar to that of a keyhole. However, other cross sections that are not rotationally symmetrical, for example triangular or rectangular cross sections, which prevent a rotation of the locking pin 9 in relation to the locking housing 7 are also possible.

Alternatively thereto, a locking pin having a circular cross section in the form of a cylinder could however also be used when the one or the plurality of latches which can also be present in the form of balls or rollers can be pivoted out of said cylinder. Such design embodiments are known from chamber closures with ball mechanisms in repeating rifles, for example. In this case, the groove should be configured in a 360° encircling manner, and the closure 5 is locked in that the coupling element 31 is rotated in relation to the locking pin 9. A corresponding face for the engagement of the locking pin 9 must thus be provided.

Figure 5:
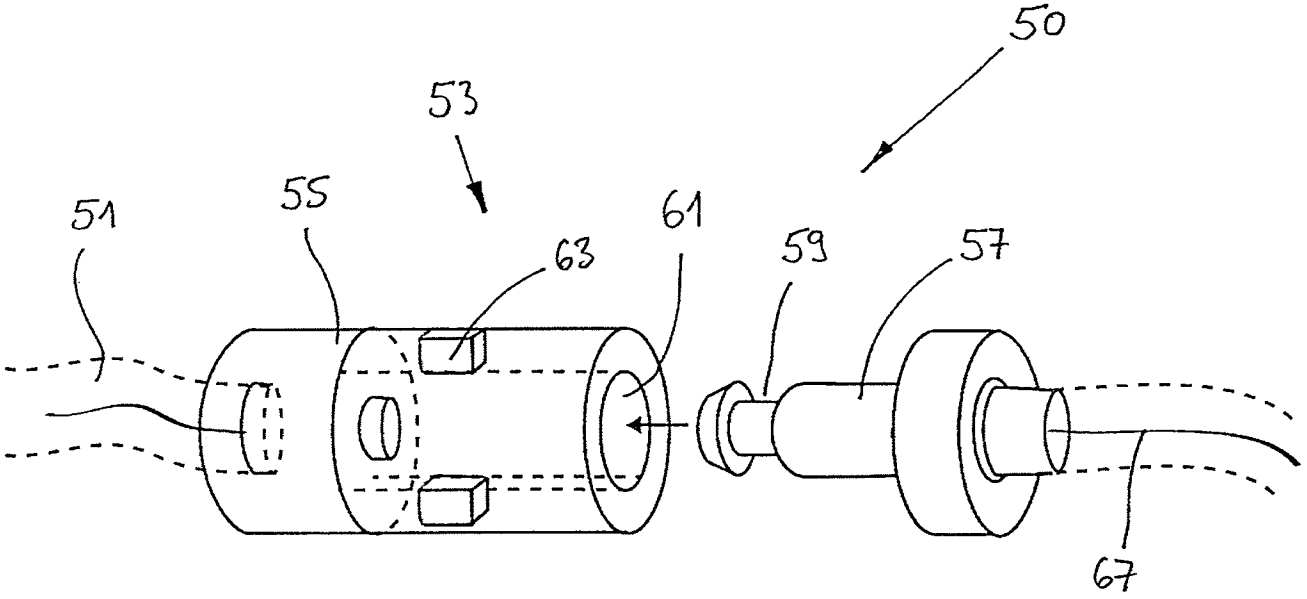
FIG. 5 shows the strand lock according to the invention as per a second preferred design embodiment, in the opened state.
Figure 6:
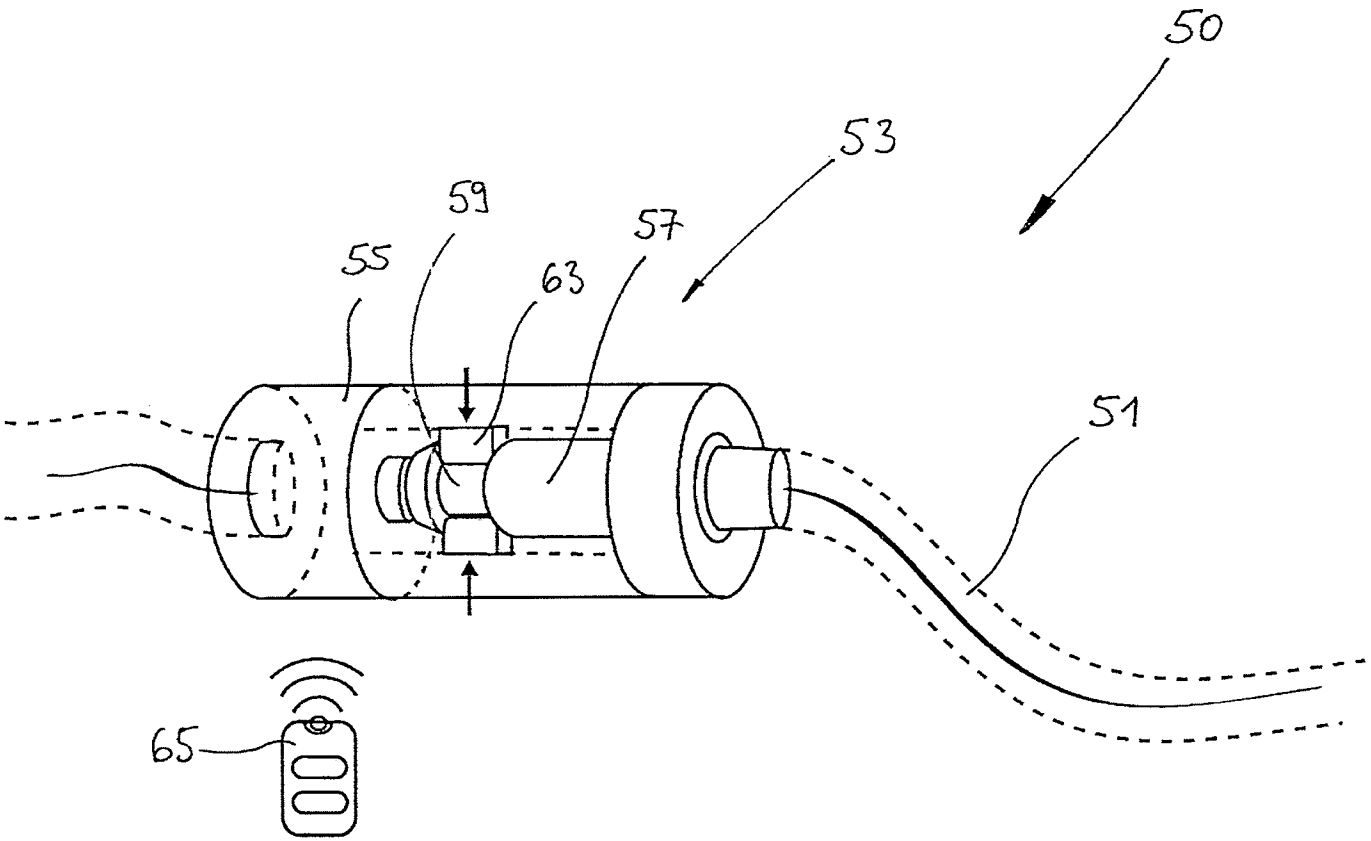
FIG. 6 shows the strand lock according to the invention as per FIG. 5, in the locked state.

The strand lock 50 as per a second preferred design embodiment is illustrated in a purely schematic manner in various views in FIGS. 5 and 6, wherein individual inboard elements for a better understanding are depicted in a partially transparent manner.

It can be seen that this strand lock 50 is again composed of a securing strand 51 and a closure 53, wherein the closure 53 has a locking housing 55 and a rotationally symmetrical locking pin 57. The locking pin 57 has an encircling groove 59. In the closed state of the closure 53 (cf. FIG. 6), when the locking pin 57 is introduced into a corresponding cylindrical receptacle 61, locking of the closure 53 can be performed by bolts 63 which, activated by a transponder 65, are introduced into the groove 59.

In the case of this design embodiment, a displacement of bolts 63 is provided by a respective drive (not shown, for example by a motor in the interior of the locking housing 53), such that rotation by hand is dispensed with.

Moreover, an encircling electrical conductor 67 is disposed in the securing strand 51, and alarm means (not shown) which trigger an alarm when the electrical conductor 67 is severed are provided.

Figure 7B:
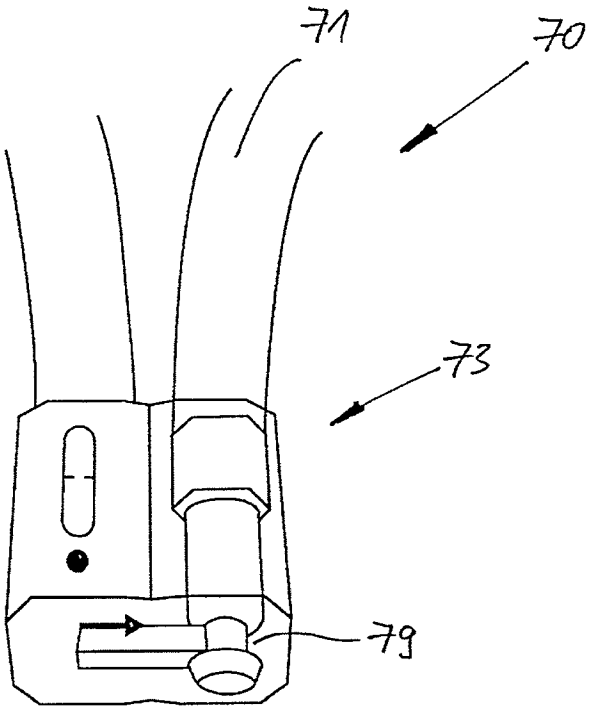
FIG. 7*b* shows the strand lock of FIG. 7*a* in the locked state.
Figure 7A:
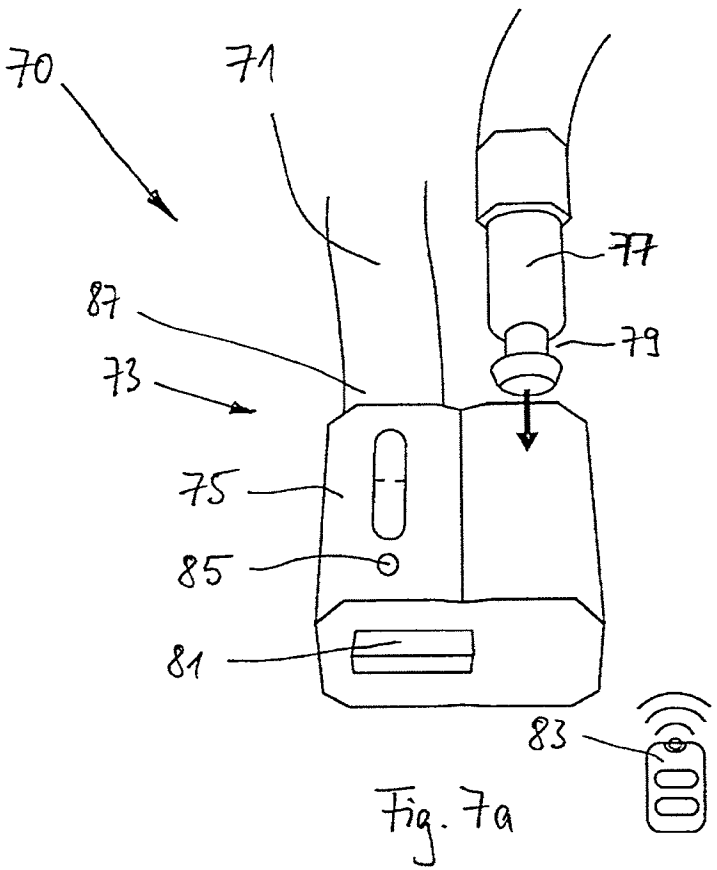
FIG. 7*a* shows the strand lock according to the invention as per a third preferred design embodiment, in the opened state.

The strand lock 70 according to the invention as per a third preferred design embodiment is illustrated in a purely schematic manner in varous views in FIGS. 7*a* and 7*b*, wherein individual inboard elements for a better understanding are depicted in a partially transparent manner.

It can be seen that this strand lock 70 is again composed of a securing strand 71 and a closure 73, wherein the closure 73 has a locking housing 75 and a rotationally symmetrical locking pin 77. The locking pin 77 has an encircling groove 79. In the closed state of the closure 73 (cf. FIG. 7*b*), when the locking pin 77 is introduced into a corresponding cylindrical receptacle (not shown), locking of the closure 73 can be performed by a bolt 81 which, activated by a transponder 83, is introduced into the groove 79. A display 85 signals whether the closure 73 is locked.

In the case of this design embodiment, only the displacement of one bolt 81 is thus provided, and the closure 73 is configured in a one-sided manner such that the strand lock 70 could be diposed in a stationary manner, for example on a frame of a bicycle (not shown).

Alliteratively hereto, it could also be provided that the closure 73 is configured so as to be separate from the one end 87 of the securing strand 71. This end 87 could be fixedly connected to the frame of a bicycle, for example, on account of which the locking housing 75 that is disposed on the frame by way of the frame would be connected indirectly to the end 87.

Furthermore, a roll-up mechanism (not shown) of the usual type could also be provided for the securing strand 3, 51, 71 such that the strand lock 1, 50, 70 becomes more easy to handle.

It has become obvious from the illustration above that a highly resilient strand lock 1 which can be operated in a very simple and uncomplicated manner is provided by the present invention, said strand lock 1 herein in comparison to known cable locks being distinguished by a high degree of flexibility and a low weight.

In as far as not stated to the contrary, all features of the present invention can be combined with one another freely and independently of other features. The features that are described in the description of the figures can also be combined with the other features, in particular with the features in the claims, in as far as not stated to the contrary, as features of the invention. For example, the intermediate layers 13, 17, or else the sheathing 21 or the wire wrappings 23, 25 do not have to be used, and only two or three braided fabrics 11, 15, 19 that lie in one another could be used.

Herein, features of the subject matter can also be used in a reworded form as method features, and method features can be used in a reworded form as features of the subject matter.

LIST OF REFERENCE SIGNS

1 Strand lock
3 Securing strand
5 Closure
7 Locking housing
9 Securing pin, locking pin
10 Textile fibers
11 Braided fabric core
13 Aluminum foil
15 Braided fabric
17 Aluminum foil
19 Braided fabric
21 Sheathing
23, 25 Wire wrappings
27 Receptacle for the locking pin
29 Latch
31 Coupling element
32 Transponder
33 End face of the coupling element 31
35 Groove
37, 39 Sleeves
50 Strand lock
51 Securing strand
53 Closure
55 Locking housing
57 Locking pin
59 Groove
61 Receptacle for the groove 59
62 Bolt
65 Transponder
67 Electrical conductor
70 Strand lock
71 Securing strand
73 Closure
75 Locking housing
77 Locking pin
79 Groove
81 Bolt
83 Transponder
85 Display

The invention claimed is:

1. A securing strand (3; 51; 71) for securing objects, wherein the securing strand is substantially composed of textile fibers, and wherein the textile fibers are present as a textile fabric selected from the group consisting of a braided fabric and a woven fabric;

the securing strand comprises at least three said textile fabrics, and at least one of said textile fabrics is a braided fabric; and said textile fabrics are arranged such that said braided fabric forms a core of the securing strand; and a metallic layer is disposed between a pair of said textile fabrics; wherein the metallic layer is a member of the group consisting of metal wires, a metallic foil, and textile fibers with a metallic coating.

2. The securing strand (3; 51; 71) as claimed in claim 1, wherein the textile fibers comprise aramid and/or ultra-high molecular weight polyethylene (UHMWP).

3. The securing strand (51) as claimed in claim 1, wherein at least one electrical conductor (67) is disposed in the securing strand (51), and that alarm means which trigger an alarm when the electrical conductor (67) is severed are provided.

4. The securing strand as claimed in claim 1 wherein the securing strand has a sheathing.

5. The securing strand (3; 51; 71) as claimed in claim 4, wherein the sheathing includes abrasive materials.

6. The securing strand (3; 51; 71) as claimed in claim 4, wherein the sheathing comprises a plastics material selected from the group consisting of polytetrafluoroethylene, an acrylic, silicone, and combinations thereof.

7. The securing strand (3; 51; 71) as claimed in claim 4 wherein the securing strand has a printable sheathing.

8. The securing strand (3; 51; 71) as claimed in claim 4 wherein the sheathing is UV-impermeable.

9. A securing strand (3; 51; 71) for securing objects, wherein the securing strand is composed of textile fibers, characterized in that the textile fibers are present as a textile fabric selected from the group consisting of a braided fabric and a woven fabric;

the securing strand comprises at least three said textile fabrics and at least one of said textile fabrics is a braided fabric;

said textile fabrics are arranged such that said braided fabric forms a core of the securing strand; and wherein a metallic layer is disposed between each textile fabric.

10. The securing strand as claimed in claim 9 wherein the metallic layer is aluminum foil.

11. The securing strand (3; 51; 71) as claimed in claim 9, wherein the metallic layer is a member of the group consisting of metal wires, a metallic foil, and textile fibers with a metallic coating.

* * * * *